US010704215B2

(12) United States Patent
Thavamani Pandi et al.

(10) Patent No.: US 10,704,215 B2
(45) Date of Patent: Jul. 7, 2020

(54) SYSTEM FOR CONSTRUCTION OF COMPOSITE U SHAPED REINFORCED GIRDERS BRIDGE DECK AND METHODS THEREOF

(71) Applicants: Vellaisamy Thavamani Pandi, Tamil Nadu (IN); Thavamani Pandi Jeyanthi Rani, Tamil Nadu (IN)

(72) Inventors: Vellaisamy Thavamani Pandi, Tamil Nadu (IN); Thavamani Pandi Jeyanthi Rani, Tamil Nadu (IN)

( * ) Notice: Subject to any disclaimer, the term of this patent is extended or adjusted under 35 U.S.C. 154(b) by 0 days.

(21) Appl. No.: 16/323,832

(22) PCT Filed: Jun. 22, 2018

(86) PCT No.: PCT/IN2018/050408

§ 371 (c)(1),
(2) Date: Feb. 7, 2019

(87) PCT Pub. No.: WO2018/193483

PCT Pub. Date: Oct. 25, 2018

(65) Prior Publication Data

US 2019/0316305 A1 Oct. 17, 2019

(30) Foreign Application Priority Data

Apr. 11, 2018 (IN) ..... 201841013760

(51) Int. Cl.
*E01D 19/12* (2006.01)
*E04C 3/294* (2006.01)
*E01D 2/00* (2006.01)

(52) U.S. Cl.
CPC ..... *E01D 19/12* (2013.01); *E04C 3/294* (2013.01); *E01D 2/00* (2013.01)

(58) Field of Classification Search
CPC ..... E01C 2/00; E01C 19/12; E04C 3/294
(Continued)

(56) References Cited

U.S. PATENT DOCUMENTS 2,921,354 A * 1/1960 Pankey ..... B28B 7/0088 249/9
4,669,143 A * 6/1987 Schambeck ..... E01D 2/02 14/73

(Continued)

FOREIGN PATENT DOCUMENTS

CN 101864729 A 10/2010
EP 2143843 A2 1/2010

(Continued)

OTHER PUBLICATIONS

International Search Report for PCT/IN2018/050408; dated Aug. 8, 2018, 2 pages.

(Continued)

*Primary Examiner* — Raymond W Addie
(74) *Attorney, Agent, or Firm* — Roach, Brown, McCarthy & Gruber, P.C.; Kevin D. McCarthy

(57) ABSTRACT

A composite bridge deck including U shaped reinforced concrete and steel girders, and construction methods thereof. The bridge deck consists of a plurality of steel main girders with unsymmetrical top flange, the plurality of cross girders being connected above bottom flange of main girders and U shaped RCC girder comprising of concrete flange above main girder, web and deck slab above cross girder. Inspection path/crash barrier provided for Rail/Road. This bridge deck is adoptable up to 3 Tracks/four lane Roads. In Cast in situ construction, main girders are placed over supports. Cross girders are connected and concreted. In precast construction, main girder with top slab is precast and placed over supports. Two or more cross girders with precast slab are connected to web of main girder. Concrete web portion is cast in situ.

9 Claims, 6 Drawing Sheets

(58) Field of Classification Search
USPC ..... 14/73, 74, 74.5, 77.1, 78; 52/81.6
See application file for complete search history.

(56) References Cited

U.S. PATENT DOCUMENTS 4,709,456 A * 12/1987 Iyer ..... E04C 3/10 14/74.5
5,145,278 A * 9/1992 Lohrmann ..... E01D 19/103 14/73
5,339,475 A * 8/1994 Jaeger ..... E01D 2/02 14/73
5,425,152 A * 6/1995 Teron ..... E01D 2/00 14/24
5,471,694 A * 12/1995 Meheen ..... E01D 2/04 14/73
5,634,308 A * 6/1997 Doolan ..... E01D 2/00 14/73
6,081,955 A * 7/2000 Dumlao ..... B63B 5/24 14/73
8,544,129 B2 * 10/2013 Won ..... E01D 2/00 14/24
9,309,634 B2 * 4/2016 Grace ..... E01D 19/125
10,494,779 B2 * 12/2019 Dagher ..... E04O 3/291
2003/0061672 A1 * 4/2003 Eustace ..... E01D 2/00 14/77.1
2005/0283926 A1 * 12/2005 Pollard ..... E01D 21/00 14/77.1
2007/0000077 A1 * 1/2007 Wilson ..... E01D 19/125 14/73
2009/0013482 A1 * 1/2009 Kennedy ..... E01D 22/00 14/77.1
2010/0170050 A1 * 7/2010 Inose ..... B23K 9/025 14/73
2018/0030745 A1 * 2/2018 Dinmore ..... E01D 19/103
2019/0376289 A1 * 12/2019 Hirayama ..... E04B 1/16

FOREIGN PATENT DOCUMENTS

JP 2002250009 A 9/2002
KR 100825441 B1 4/2008
KR 100881921 B1 2/2009
KR 101476290 B1 12/2014
KR 101654657 B1 9/2016

OTHER PUBLICATIONS

Written Opinion of the International Searching Authority for PCT/IN2018/050408; dated Aug. 8, 2018, 5 pages.

* cited by examiner

SYSTEM FOR CONSTRUCTION OF COMPOSITE U SHAPED REINFORCED GIRDERS BRIDGE DECK AND METHODS THEREOF

FIELD OF THE INVENTION

The present invention relates to the field of bridge engineering in particular to steel concrete composite bridge deck for economical and fast track construction. More particularly, the present invention relates to the system and method of construction of composite U shaped reinforced concrete and steel girders bridge deck for use in Railway, Metro and Highway bridges.

BACKGROUND OF THE INVENTION

In composite construction of Road bridges, the main girders are placed along traffic direction at spacing of around 2.5 m to cover the deck width. Each girder is designed to take live loads passing in that alignment. Construction depth plays an important role in the design of the bridge and cost of approach. The depth of construction (top of road level to bottom of girder) is 2 m to 3.5 m for spans of 24 m to 45 m. Half through steel girders are constructed and it can be adopted for shorter spans due to its lesser moment of inertia.

In multi girder system, the each girder is designed to take loads in that strip. The depth of construction (bottom of main girder to road level) is high. Weight of steel used is high. Bracing and diaphragm arrangements add to weight and increase construction time. The construction is to be done in situ. Trestle beams and multiple columns are needed to support the deck. Elaborate formworks are needed. The crossing needs to be closed interfering traffic, which is not suitable for fast track construction. Ladder deck system steel usage is less but depth of construction is more, which leads to increase in the approach cost. More area exposed makes it vulnerable for rain and weathering agents. Half through steel construction main girder steel property alone is used. More depth of girder and quantum of steel are required, which is adoptable for short spans. More area exposed makes it vulnerable for rain and weathering agents. PSC U girder is used only for single lane Railway bridges. The casting is done at site needing elaborate form work, which is constructed for short spans up to 18 m and also not suitable for multi lane Road/Railway bridges.

Multi girder composite girder road over bridges with girder spacing around 2.5 m are constructed. Twin Girder ladder decks are constructed with cross girders at top flange level. Half through steel girders are being constructed, where main girder steel property alone is used. U shaped PSC girders are constructed for single lane Railway bridges for short spans. U shaped RCC girder and steel girder composite bridge has been constructed at Loco Works Railway station near Chennai for single lane road with main I girders of symmetrical sections flat bottom and top cross girders. The web of U girder is broken due to symmetrical flange of main girder. The top flange width of concrete is unequal and composite properties of the main girders are not fully used.

One of the prior art KR101654657, discloses a bridge construction method using the side beam and the slab segments. The through bridge comprises: the two or more side beams arranged at intervals in the transverse direction, wherein the bottom of an end is supported on the upper surface of both abutment units spaced from each other in the longitudinal direction forming a lower foundation; both end flanges directly supported on the upper surface of the side beam; and a U-shaped slab segment including a U-shaped floor board unit formed between the both end flanges, wherein the U-shaped floor board unit is in contact with the inner surface of the side beams adjacent to each other and supports the inner side of the both side beams in the transverse direction as the U-shaped floor board unit is in contact with the both end flanges directly supported on the upper surface of the side beam. The drawbacks of the above invention: slab spans between main girders which are supported over abutments and deck width is less, which is not suitable for multilane Road/Rail and longer spans. The existing traffic is obstructed due to abutments supporting main girders and elaborate formwork arrangement.

Another prior art KR101476290 discloses a steel composite PSC corrugated steel plate U girder comprising: a lower flange (10) comprising a concrete layer (12) and a number of PS steel materials (11) provided inside the concrete layer (12) in a longitudinal direction; a pair of composite parts (20) connected respectively to both sides of the lower flange (10) such that the pair of composite parts are provided at an upper distance larger than a lower distance in distance between composite parts; and a pair of upper flanges (30) formed from concrete and connected respectively to upper sides of the pair of composite parts (20), in which the composite parts (20) comprises corrugated steel plates (24), lower coupling members (22) configured to couple lower portions of the corrugated steel plates (24) to the concrete (12) of the lower flange (10), and upper coupling members (26) configured to couple upper portions of the corrugated steel plates (24) to the concretes of the upper flanges (30). The corrugated plates of the above invention form web independent pair of composite parts and which is not suitable for wider/multi-lane Road/Railway bridges.

Yet another prior art KR100881921 "Opening steel composite U girder construction method" discloses a trapezoidal shaped opening type steel girder with high strength concrete in upper flange positive moment region and negative moment region with partial pre stressing.

From the above description, it is understood that the previous construction methods were being observed, which is not suitable for multilane road/rail and traffic obstructed. Two girders are adequate in place of multi girder to take loads and forces. U shaped RCC girder with steel girder bridges are being constructed with cross girder arrangement at the bottom level. There is a need for a construction of composite U shaped reinforced concrete and steel girders bridge deck by a way of providing a new force transfer system with composite interaction of U shaped RCC girder, main girder and cross girders resulting in substantial reduction of deflection and moments at center of span in main/cross girders making it suitable for longer spans.

OBJECT OF THE INVENTION

Accordingly, the primary object of the present invention is to provide a system and method of construction of composite U shaped reinforced concrete and steel girders bridge deck.

1. The primary object of the present invention is to provide a U shaped RCC girder over steel main girders and cross girders in grid pattern.
2. It is another object of the present invention to ensure that main girder top flange is kept unsymmetrical to take U slab over top flange.

3. It is yet another object of the present invention to provide, cross girders which is placed at 5 cm above bottom flange of main girder, and end girders which are placed over the bottom flange of main girder and connected to both web and flange of main girder for better transfer of loads to bearing.
4. It is even another object of the present invention to provide cross girders whose bottom flanges are bent to match bottom flanges of main girder.
5. It is yet another object of the present invention to provide cross girders whose top flanges are bent to provide camber in carriage way.
6. It is another object of the present invention to provide a new force transfer system with composite interaction of U shaped RCC girder and main girders resulting in substantial reduction of deflection and moments at centre of span in main girders making it suitable for longer span.
7. It is yet another object of the present invention to provide U shaped RCC girder whose frame action results in substantial reduction of moments and deflection in cross girders.
8. It is even another object of the present invention to provide hindrance free and fast track construction of bridge due to absence of trestle beams/supports in the crossing and from work.

SUMMARY OF THE INVENTION

It will be understood that this disclosure is not limited to the particular systems, and methodologies described, as there can be multiple possible embodiments of the present disclosure which are not expressly illustrated in the present disclosure. It is also to be understood that the terminology used in the description is for the purpose of describing the particular versions or embodiments only, and is not intended to limit the scope of the present disclosure.

According to the basic aspect of the present invention, there is provided a system of construction of composite U shaped reinforced girders bridge deck comprising a plurality of main girder, a plurality of cross girders including end cross girders and intermediate cross girders, U shaped RCC girder, drainage duct/inspection path (Railway/Metro), a crash barrier (Highways) and a track. The main girders (made of steel) are provided with an unsymmetrical top flange, web and symmetrical bottom flange. Cross girders are connected above bottom flange of main girder. The cross girders are bent near support in such a way to match said bottom flange of said main girder. The end cross girders are U shaped encasing RCC beam and intermediate cross girders are I girders. The uniform spacing of cross girders is around 2.5 m. The U shaped RCC girder is provided with a top flange, a web and a deck slab, such that deck slab is constructed over cross girders connected to said web at 5 cm above said bottom flange of main girder. The deck slab, concrete web and the concrete over said top flange of main girder forms U shape. The foot path of 1.5 m or service path of 0.45 m is provided between said crash barrier and said web of U shaped RCC girder. Inspection path cum cable/drainage duct is provided over Railway/Metro bridges.

Moreover, the top flange of said main girder is unsymmetrical to thereby take said U shaped RCC girder over said top flange. The top flange of said main girder is projected inside a concrete by 3 cm for welding. The properties of main girder, cross girders and U girder are modified to increase moment of inertia. The stiffeners are provided on outer face of the main girders. The top flange of cross girders is bent to provide camber in a carriage way which is used upto four lanes for highway and upto three lanes for railway/metro track. The frame action of the system reduces the moment and deflections in both main and cross girders. To economize construction of main and cross girders, pre camber is provided to counteract dead load and 50% of live load deflections. The semi through steel composite girder arrangement is possible to provide spans up to 36 m with plate girder E250/350 grade and Span 45 m above with E410 grade. For spans 45 and above, pre camber is to be provided to contain deflection less than L/600. Light weight concrete of density 1600 kg/m3 made of Expanded Shale Clay and Slate can be used to economies the construction cost in adopting the same section for longer spans.

According to an another aspect of the present invention, there is provided a precast method of construction of composite U shaped reinforced concrete and steel girders bridge deck, comprising the steps of precasting main girders with top slab to enhance moment of inertia to thereby carrying dead loads and live loads. The web can be precast if handling capacity is available. To avoid formwork, said main girders with said slab is precast upside down, whereas the grade of concrete can be equal or higher than deck concrete so that the stresses are in permissible limits. Two or more cross girders is precast with top slab to get moment of inertia enhanced thereby to carry dead loads and live loads. The main girders with top slab are kept in position. Cross girders with deck are to be connected to web of main girders and concrete web can be cast in situ.

According to an another aspect of the present invention, there is provided an in situ method of construction of composite U shaped reinforced concrete and steel girders bridge deck, comprising the steps of placing main girders in a position where said cross girders are to be connected. Concreting can be done in one go. To economise construction, the concreting is first performed in slab over top flange of main girder and web portion. The deck sheet of 6 mm mild steel can be spread over top of said cross girders and being welded with 3 mm fillet welds. The concreting in deck portion is performed to ensure better transfer of forces and control of deflection after 14 days of concreting flange and web portion of main girder. Crash barriers, wearing coat, inspection path cum drainage cum cable duct and protective arrangements are to be made before opening to traffic.

BRIEF DESCRIPTION OF THE ACCOMPANYING DRAWINGS

The above set forth and other features of the invention are made more apparent in the ensuring detailed description of the invention, when read in conjunction with the accompanying drawings, wherein.

Figure 4:
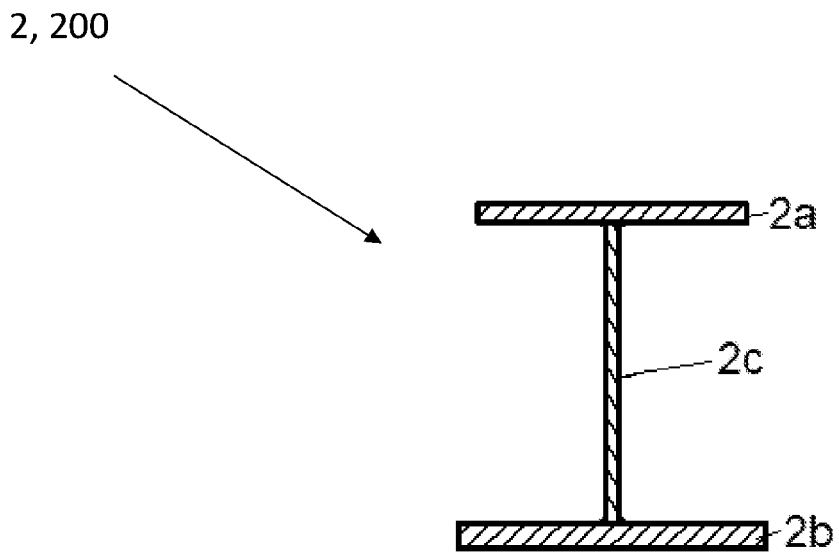

FIG. 4. illustrates an intermediate cross girder that is an I-shaped girder, according to the present invention.

Figure 5:
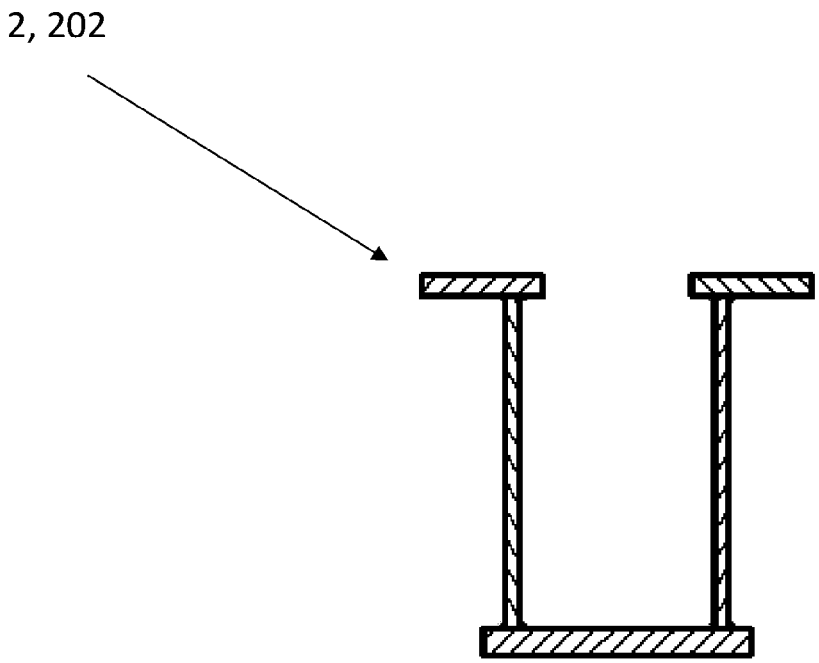

FIG. 5 illustrates an end cross girder that is a U shaped encasing RCC beam, according to the present invention.

Figure 2:
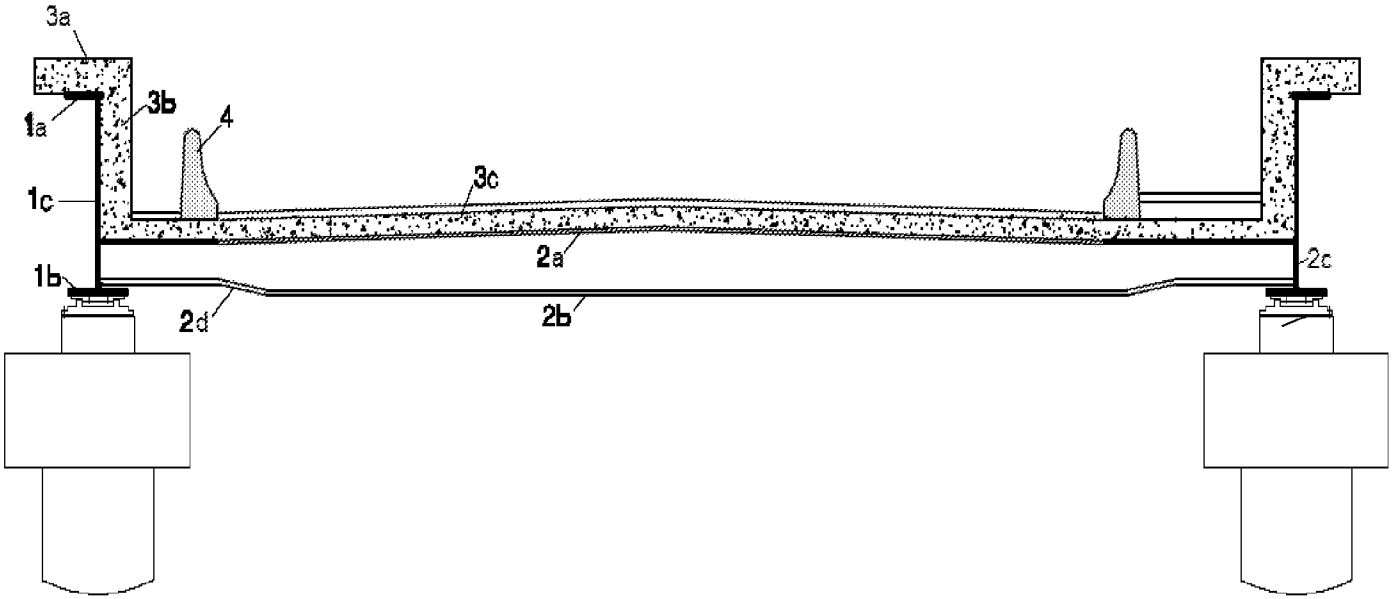
FIG. 2 illustrates the schematic representation of system of construction of composite U shaped reinforced concrete and steel girders bridge deck implemented in a highway bridge, according to the present invention.
Figure 6:
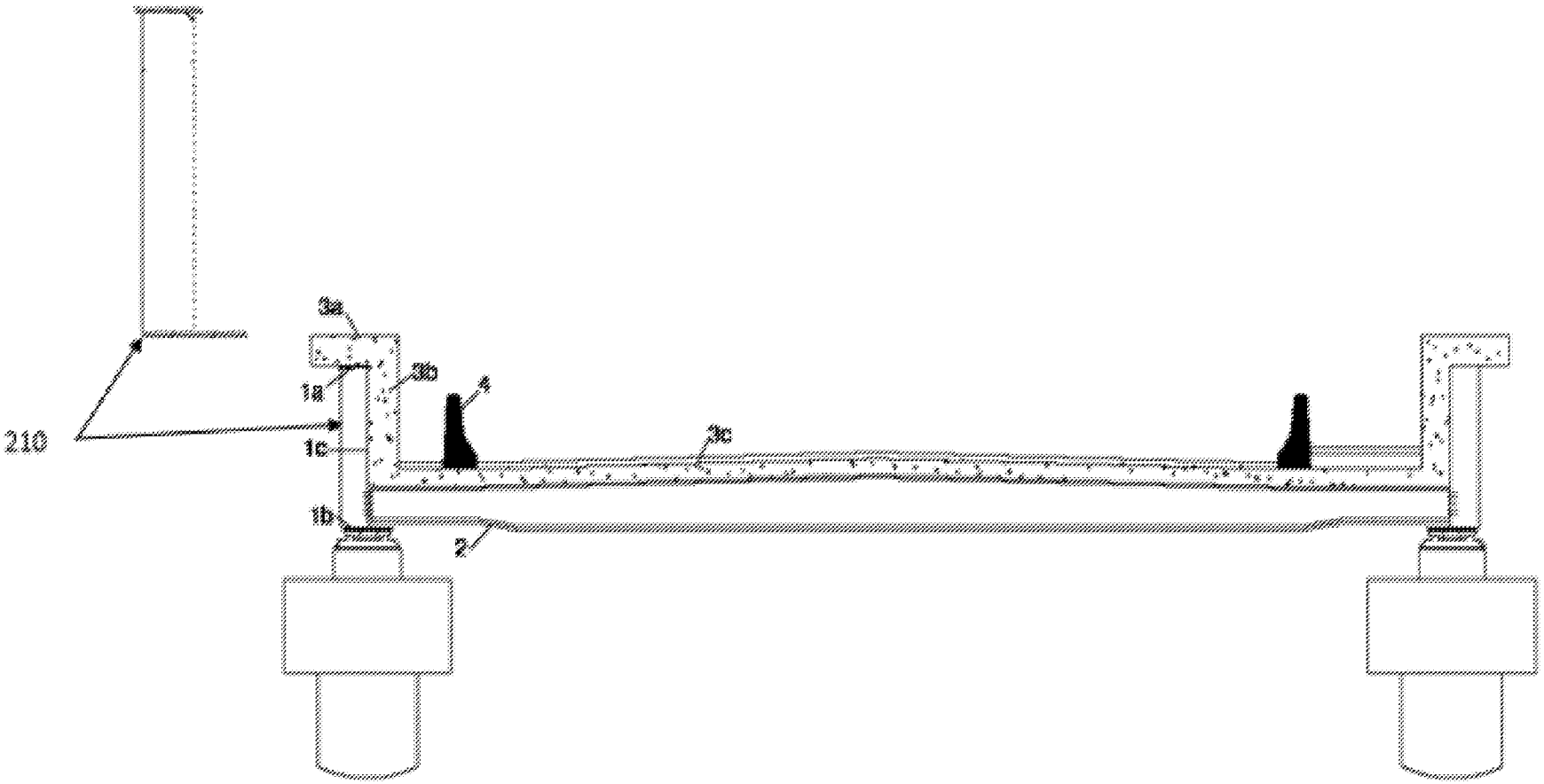

FIG. 6 illustrates an alternative view of FIG. 2 with a stiffener, according to the present invention.

DETAILED DESCRIPTION OF INVENTION WITH REFERENCE TO THE ACCOMPANYING DRAWINGS

The preferred embodiment of the present invention will now be explained with reference to the accompanying drawings. It should be understood however that the disclosed embodiments are merely exemplary of the invention, which may be embodied in various forms. The following description and drawings are not to be construed as limiting the invention and numerous specific details are described to provide a thorough understanding of the present invention, as the basis for the claims and as a basis for teaching one skilled in the art how to make and/or use the invention. However in certain instances, well-known or conventional details are not described in order not to unnecessary obscure the present invention in detail.

Figure 1:
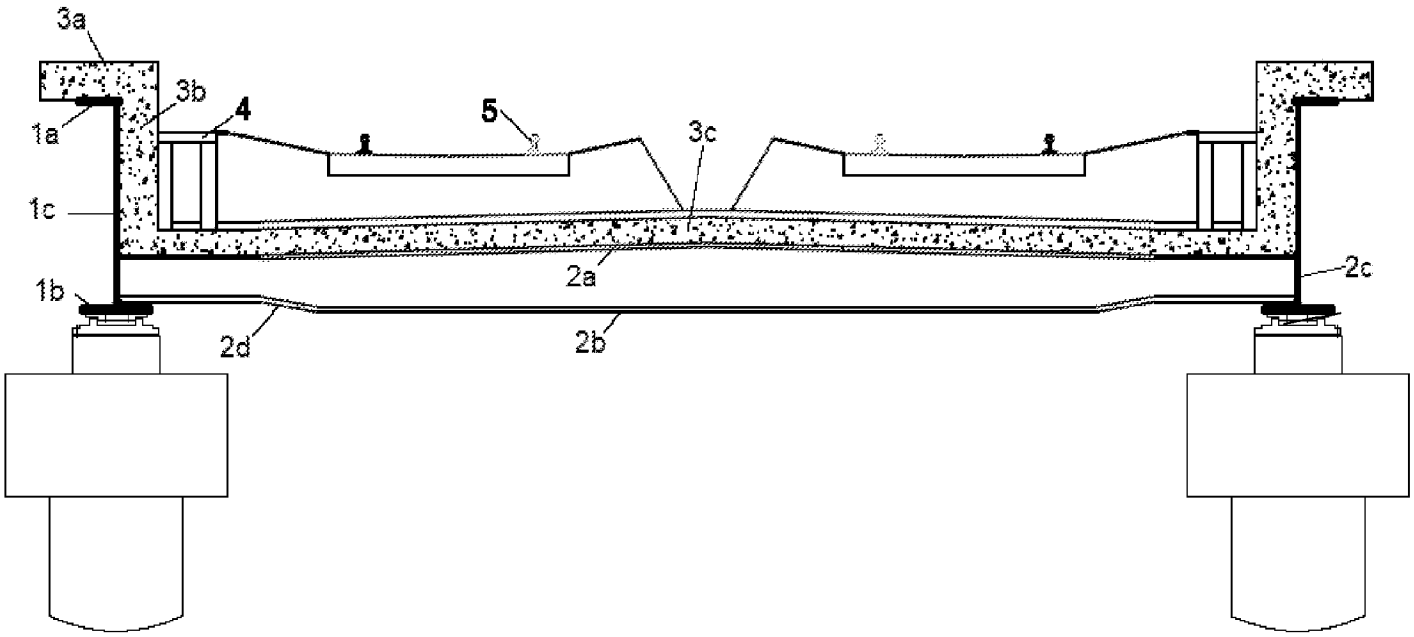
FIG. 1 illustrates the schematic representation of system of construction of composite U shaped reinforced concrete and steel girders bridge deck implemented in a railway bridge, according to the present invention.
Figure 3:
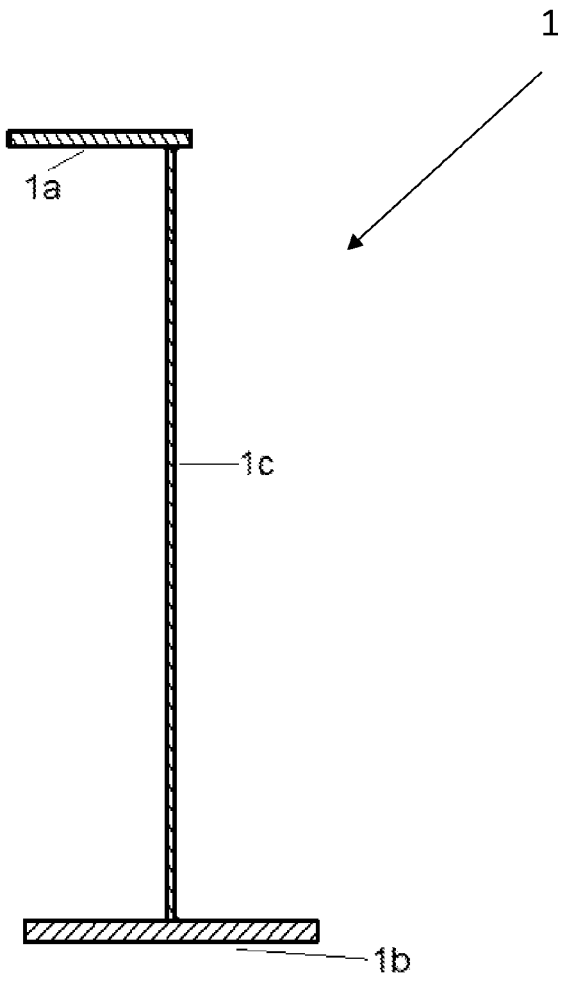
FIG. 3 illustrates an alternative version of a main girder having a stiffener, according to the present invention.

With reference to the FIG. 1, the invention is illustrated as applied to, the schematic representation of system of construction of composite U shaped reinforced concrete and steel girders bridge deck implemented in a railway bridge, comprising a plurality of main girder (1), a plurality of cross girders (2) including end cross girders and intermediate cross girders, U shaped RCC girder, drainage duct (4), and a track (5). The main girders (made of steel) are illustrated at FIG. 3 and provided with an unsymmetrical top flange (1*a*), a symmetrical bottom flange (1*b*) and a web (1*c*). The cross girders (2) are connected to the main girders. The cross girders are bent near support in such a way to match said bottom flange (1*b*) of said main girder. The uniform spacing distance of main girders and said cross girders is at 2.5 m. The end cross girders are, as illustrated at FIG. 5, the U shaped encasing RCC beam (2 and 200) and the intermediate cross girders, as illustrated at FIG. 4, are I girders (2 and 202). The U shaped RCC girder is provided with a top flange (3*a*), a web (3*b*) and a deck slab (3*c*), such that said deck slab (3*c*) and said web (3*b*) are constructed over cross girders and flange (3) over unsymmetrical top flange (1*a*) of main girder. The concrete deck slab (3*c*), web (3*b*) and the said concrete flange (3*a*) forms U shape. The top flange (1*a*) of said main girder is unsymmetrical to thereby take said U shaped RCC girder over said top flange (1*a*). The top flange (1*a*) of said main girder is projected inside a concrete by 3 cm for welding.

In one embodiment of the present invention, the stiffeners (210), as illustrated at FIG. 6 are provided on outer face of said main girders. The top flange of cross girder (2) is bent to provide camber in a carriage way which is used up to four lanes for Highway and up to three lanes for Railway/Metro track. Construction of composite U shaped reinforced concrete and steel girders bridge deck by a way of providing a new force transfer system with composite interaction of U shaped RCC girder, main girder and cross girders resulting in substantial reduction of deflection and moments at centre of span in main girder and cross girders and adoptable for longer span.

With reference to the FIG. 2, the invention is illustrated as applied to, schematic representation of system of construction of composite U shaped reinforced concrete and steel girders bridge deck implemented in a Highway bridge, comprising a plurality of main girder, a plurality of cross girders (2) including end cross girders and intermediate cross girders, U shaped RCC girder and a crash barrier (4).

In another embodiment of the present invention, wherein foot path of 1.5 m or service path of 0.45 m is provided between said crash barrier (4) and said web (3*b*) of U shaped RCC girder.

Advantages of the Present Invention

1. The present invention ensures that light weight and less depth deck results in lighter sub structure and foundation and also lesser approach length and in turn reduces land acquisition. It reduces bridge and approach cost and helps fast track construction and thus eliminates cost and time overrun. Composite action of main girder makes the structure lighter and adoptable for longer spans up to 72 m span with improved aesthetic appearance.
2. For the existing Railway, Metro and Highway bridges lighter deck without trestle beam is suitable for fast track rehabilitation/rebuilding with increased spans apart from increased vertical clearance and overall saving in the bridge cost.
3. The girders can be factory made resulting in better quality and lesser work at site leading to fast track and quality construction.
4. The main girder with slab on top can be precast and the deck can be precast with cross girder and being connected to each other, which leads to fast track construction. Precast twin girder system can be launched over supports with minimum concreting over web portion. Absence of bracing system diaphragm, trestle beam connecting columns/supports, elaborate formwork arrangements and least interference to the traffic also makes it suitable for fast track construction.
5. Alternately main girder and cross girder can be launched and deck sheet of 6 mm mild steel can be spread and welded to cross girder and concreted in situ construction method. The reinforcements can be preassembled. Absence of bracing system diaphragm, trestle beam connecting columns/supports, elaborate formworks and least interference to traffic makes it suitable for fast track construction.
6. Part or full deck can be precast to have composite properties in advance to reduce the girder depth, weight, deflection and the weight of substructure and foundation. The overall cost of bridge can be reduced by more than ⅓rd.
7. The weight of steel used is reduced by designing two main girders with U shaped RCC girder to share the load in place of half through steel girder deck with steel girder property alone.
8. The depth of construction is less compared to twin girder composite ladder deck whereas the depth of construction (i.e) road top to bottom of cross/main girder is around 1 m for carriage way upto four lanes for highways and upto three lanes for railway or metro track. The meter reduction in road level reduces the approach length by 60 m.
9. The durability of bridge is more due to lesser exposure to rain and weathering agents compared to Twin girder ladder deck and half through steel girder.

It is emphasized that the Abstract of the Disclosure is provided to allow a reader to quickly ascertain the nature of the technical disclosure. It is submitted with the understanding that it will not be used to interpret or limit the scope or meaning of the claims. In addition, in the foregoing Detailed Description, it can be seen that various features are grouped together in a single embodiment for the purpose of streamlining the disclosure. This method of disclosure is not to be interpreted as reflecting an intention that the claimed embodiments require more features than are expressly recited in each claim. Rather, as the following claims reflect, inventive subject matter lies in less than all features of a single disclosed embodiment. Thus the following claims are hereby incorporated into the Detailed Description, with each claim standing on its own as a separate embodiment. In the appended claims, the terms "including" and "in which" are used as the plain-English equivalents of the respective terms "comprising" and "wherein," respectively. Moreover, the terms "first," "second," "third," and so forth, are used merely as labels, and are not intended to impose numerical requirements on their objects.

Without further description, it is believed that one of ordinary skill in the art can, using the preceding description and the illustrative examples, make and utilize the present invention and practice the claimed methods. It should be understood that the foregoing discussion and examples merely present a detailed description of certain preferred embodiments. It will be apparent to those of ordinary skill in the art that various modifications and equivalents can be made without departing from the spirit and scope of the invention.

The invention claimed is:

1. A composite bridge deck including U shaped reinforced cement concrete (RCC) and steel girders, comprising:

a plurality of main girders including an unsymmetrical top flange, a symmetrical bottom flange and a web;

a plurality of cross girders including end cross girders and intermediate cross girders, being connected to said main girders, wherein said cross girders are carved near support in such a way to match said bottom flange of said main girder;

at least one U shaped RCC girder provided with a top concrete flange, a second web and a concrete deck slab, wherein, said concrete deck slab and said second web are constructed over said cross girders and concrete flange over unsymmetrical top flange of main girder and whereas said concrete deck slab, said second web and concrete flange over said top flange of main girder forms U shape; and at least one crash barrier, wherein foot path of 1.5 m or service path of 0.45 m is provided between said crash barrier and said second web of U shaped RCC girder.

2. The composite bridge deck including U shaped reinforced cement concrete (RCC) and steel girders as claimed in claim 1, wherein each cross girder has a uniform spacing distance of 2.5 m from an adjacent cross girder.

3. The composite bridge deck including U shaped reinforced cement concrete (RCC) and steel girders as claimed in claim 1, wherein said end cross girders are U shaped encasing RCC beam and intermediate cross girders are I girders.

4. The composite bridge deck including U shaped reinforced cement concrete (RCC) and steel girders as claimed in claim 1, further comprising stiffeners being provided on outer face of said main girders.

5. The composite bridge deck including U shaped reinforced cement concrete (RCC) and steel girders as claimed in claim 1, comprising said main girders which are made of steel.

6. The composite bridge deck including U shaped reinforced cement concrete (RCC) and steel girders as claimed in claim 1, comprising said cross girder whose top flange is bent to provide camber in a carriage way which is used upto four lanes for highway and upto three lanes for railway/metro track.

7. The composite bridge deck including U shaped reinforced cement concrete (RCC) and steel girders as claimed in claim 1, whose frame action reduces the moment and deflections in said main and cross girders making it suitable for longer spans.

8. A precast method of construction of composite bridge deck including U shaped reinforced cement concrete (RCC) and steel girders, comprising the steps of:

assembling steel main girders and cross girder fabricated with shear connectors at site for spans more than 15 m;

casting upside down said main girders with top concrete flange, precasting two or more cross girders with top slab to get moment of inertia enhanced thereby to carry dead loads and live loads; and placing said main girders including an unsymmetrical top flange, with top concrete flange in a position over supports where cross girders with deck are to be connected to the web of main girder and casting of web portion in situ.

9. An in situ method of construction of composite bridge deck including U shaped reinforced cement concrete (RCC) and steel girders, comprising the steps of:

assembling steel main girders and cross girders fabricated with shear connectors at site for spans more than 15 m;

placing main girders including an unsymmetrical top flange, in a position where said cross girders are to be connected;

performing concreting in slab over top flange of main girder and web portion;

spreading 6 mm mild steel (MS) deck sheet over top of said cross girders and being welded with 3 mm fillet welds; and performing concreting in the deck portion after 14 days of concreting over top flange and web portion of main girders slab.

* * * * *